US008866688B2

(12) United States Patent
Liu

(10) Patent No.: US 8,866,688 B2
(45) Date of Patent: Oct. 21, 2014

(54) DUAL-POLARIZED RADIATION ELEMENT AND PLANAR OSCILLATOR THEREOF

(75) Inventor: Liangtao Liu, Guangzhou (CN)

(73) Assignee: Comba Telecom System (China) Ltd. (CN)

( * ) Notice: Subject to any disclaimer, the term of this patent is extended or adjusted under 35 U.S.C. 154(b) by 647 days.

(21) Appl. No.: 13/143,114

(22) PCT Filed: Dec. 17, 2009

(86) PCT No.: PCT/CN2009/075661
§ 371 (c)(1),
(2), (4) Date: Jul. 1, 2011

(87) PCT Pub. No.: WO2010/078797
PCT Pub. Date: Jul. 15, 2010

(65) Prior Publication Data

US 2011/0291905 A1 Dec. 1, 2011

(30) Foreign Application Priority Data

Jan. 12, 2009 (CN) ..... 2009 1 0036577

(51) Int. Cl.
*H01Q 21/26* (2006.01)

(52) U.S. Cl.
USPC ..... 343/797; 343/700 MS; 343/870

(58) Field of Classification Search
USPC ..... 343/797, 870, 700 MS
See application file for complete search history.

(56) References Cited

U.S. PATENT DOCUMENTS

2011/0050536 A1* 3/2011 Shtatnov et al. ..... 343/870

FOREIGN PATENT DOCUMENTS

| | | | |
|---|---|---|---|
| CN | 1591976 | A | 3/2005 |
| CN | 2731741 | Y | 10/2005 |
| CN | 1988260 | A | 6/2007 |
| CN | 201011672 | Y | 1/2008 |
| CN | 201117803 | Y | 9/2008 |
| CN | 101465475 | A | 6/2009 |
| WO | 2007114620 | A1 | 10/2007 |

OTHER PUBLICATIONS

International Search Report for application No. PCT/CN2009/075661 dated Apr. 1, 2010.

* cited by examiner

*Primary Examiner* — Karl D Frech
(74) *Attorney, Agent, or Firm* — Lerner, David, Littenberg, Krumholz & Mentlik, LLP

(57) ABSTRACT

A planar oscillator is provided includes an oscillator portion formed by four oscillator arms, the four oscillator arms defining two orthogonal half-wave oscillators, each oscillator arm being of a square and these oscillator arms being arranged in a square configuration, each oscillator arm having a feeding terminal defined at a corner thereof facing another oscillator arm; a connective portion connected among these oscillator arms so that these arms are connected with each other; and a medium base plate for printing the oscillator portion and connective portion thereon. In addition, a plurality of through holes is defined in the medium base plate. The antenna made according to the invention is simple and compact in construction and good in performance. In addition, the antenna is easy to be manufactured and assembled. Moreover, the antenna of the invention benefits from wide bandwidth, high gain and cross polarization ratio, and excellent isolation.

8 Claims, 4 Drawing Sheets

DUAL-POLARIZED RADIATION ELEMENT AND PLANAR OSCILLATOR THEREOF

CROSS REFERENCE TO RELATED APPLICATIONS

The present application is a national phase entry under 35 U.S.C. §371 of International Application No. PCT/CN2009/075661, filed Dec. 17, 2009, which claims the benefit of Chinese Patent Application No. 200910036577.7, filed Jan. 12, 2009, the entire disclosures of which applications are incorporated herein by reference.

FIELD OF THE INVENTION

The invention relates to a base station antenna used in a mobile communication system and more particularly, relates to a dual-polarized radiation element and planar oscillator thereof.

BACKGROUND

With the rapid development of mobile communication technology, electromagnetic environment gets more and more complicated, which means rigid requirement for design of dual-polarized directional antenna used in mobile communication system should be met. High quality of electrical performance is required for some antennae such as great gain, cross polarization discrimination of the main axis of more than 20 dB, cross polarization discrimination of more than 10 dB, good directionality and beam convergence. In addition, good adaptability to the ambient surroundings, small size, lightweight and aesthetic appearance is also desired. Further, low cost is also desired to win in the competing market.

To a large extent, the radiation element of an array antenna determines much performance of the antenna such as the gain, width of the beam, beam convergence, as well as cross polarization. In design of a base station antenna of high gain, it is required to improve the gain of the antenna radiation element as high as possible in consideration of meeting beam width limitation. The dual polarized radiation oscillator is also required to bear excellent cross polarization property.

A wideband dual polarized antenna oscillator is disclosed in Chinese Utility Patent No. CN201117803Y issued on Sep. 17, 2008. In this patent disclosure, a planar oscillator similar to the invention is manufactured by printed circuit board. The planar oscillator is separated into two parts which are interconnected with each other physically and electrically coupled with each other rather than direct connection. That is, a first surface radiation construction defining the periphery and a second surface radiation construction defining the interior of the planar oscillator. Then, a plurality of through holes is defined in corners of respective oscillator arms at the middle location of the second surface radiation construction. Next, a support body having several grooves defined therein passes through the through holes of the corners provided on the medium base plate and then a feeding cable is bent and welded.

It seems that the above structure is somewhat complex for a person of ordinary skill in the art in view of above heavy description and accordingly, it is inconvenient for this structure to be manufactured.

Additionally, though it is alleged in the above patent disclosure that the characteristics of antenna is enhanced, attention should be paid to weak signal energy due to coupling other than direction connection. In this situation, the inventor seeks for improvement upon the above conventional technology.

SUMMARY OF THE INVENTION

A primary object of the invention is to overcome drawbacks of prior art and provide a planar oscillator which is simple in construction and enhanced in its performance.

Another object of the invention is to provide a dual polarized radiation element to perfectly incorporate the above-mentioned planar oscillator therein.

To obtain the above objects, a planar oscillator is provided, which includes:

an oscillator portion formed by four oscillator arms, the four oscillator arms defining two orthogonal half-wave oscillators, each oscillator arm being of a square and these oscillator arms being arranged in a square configuration, each oscillator arm having a feeding terminal defined at a corner thereof facing another oscillator arm;

a connective portion connected among these oscillator arms so that these arms are connected with each other; and a medium base plate for printing the oscillator portion and connective portion thereon. In addition, a plurality of through holes is defined in the medium base plate.

The oscillator portion and connective portion are formed integrally by a co-plane conductive plate.

In one embodiment of the invention, the connective portion is of a square shape and is disposed at the periphery of the oscillator portion and connected with four corners of the periphery of the oscillator portion.

In one embodiment of the invention, the connective portion includes four extension frames each of which has a rectangular frame and two extension arms extended from two ends of a breaking location of a longitudinal side of the rectangular frame; the two extension arms of each extension arm are connected with two adjacent sides of two adjacent oscillator arms respectively. An opening is defined between two adjacent corners of two adjacent extension frames.

A dual polarized radiation element for forming an array of antennae includes:

A planar oscillator; and

A balanced feeding connector the bottom portion of which is secured onto a metal reflection plate of the array of antennae, while the top portion thereof is fixed to the planar oscillator for supporting a connective element for feeding power to the planar oscillator.

The balanced feeding connector comprises two identical medium plates; each medium plate has a notch defined at its middle portion longitudinally such that the two medium plates are connected with each other in a crossed manner; two bumps are formed on the top portion of each medium plate; each medium plate has a microstrip line formed at one side thereof and extended from the bumps to the bottom of the medium plate, said microstrip line passing through the through holes defined in the medium base plate of the planar oscillator for connecting with the feeding terminal so as to be grounded; each medium plate also has another microstrip line formed at the other side thereof for coupling the signals to one of the two half-wave oscillator; and these microstrip lines constitute the connective element.

The balanced feeding connector is of a cylinder shape; a cross groove is defined at the central portion of the balanced feeding connector for dividing the connector into four sectored posts; an embossment is formed on the top portion of each sectored post; a receiving hole is defined in the post and extended from the embossment downwardly to the bottom portion of the post for receiving the connective element; the connective element is of a coaxial cable and has an external conductor and internal conductor; the external conductor is connected with the inner wall of the sectored post, while the internal conductor thereof reaches the respective embossment and passes through the through hole of the medium plate of the planar oscillator so as to be connected to the feeding terminal provided on the other oscillator arm.

Compared with prior art technology, the antenna made according to the invention is simple and compact in construction and good in performance. In addition, the antenna is easy to be manufactured and assembled. Moreover, the antenna of the invention benefits from wideband, high gain and cross polarization ratio, and excellent isolation.

Other advantages and novel features will be drawn from the following detailed description of embodiments with attached drawings, in which:

DETAILED DESCRIPTION

Various embodiments of the invention are now described with reference to accompanying drawings.

Figure 1:
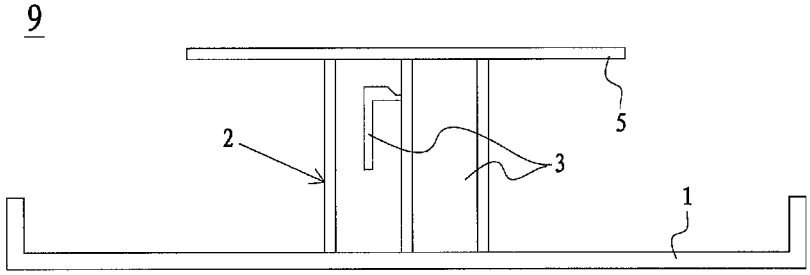
FIG. 1 is a side view of a dual polarized radiation element constructed of planar oscillator of the invention.

Referring to FIG. 1, a dual polarized radiation element 9 for construction of a dual polarized array of antenna is shown to have a metal reflection plate 1, a balanced feeding connector 2, a connective element 3 and a planar oscillator 5. The balanced feeding connector 2 is secured onto the metal reflection plate 1 for supporting and securing the planar oscillator 5. The connective element 3 functions to supply power to the planar oscillator 5 and generally may take the form of a coaxial cable, a micro-strip line and so on. The arrangement of the connective element 3 is subject to the location of the balanced feeding connector 2.

Figure 2:
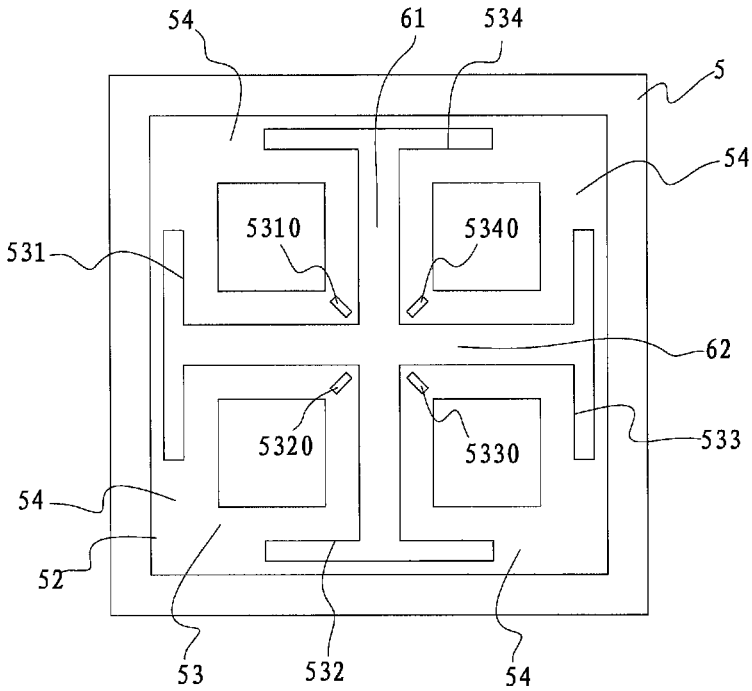
FIG. 2 shows a top plan view of a planar oscillator according to the invention.

FIG. 2 shows a planar oscillator 5 of a preferred embodiment of the invention. It can be seen from the drawing that the oscillator 5 includes a medium base plate 51 made of PVC, a connection portion 52 and an oscillator portion 53 both of which are printed on the same surface of the medium base plate 51. The connection portion 52 and oscillator portion 53 are formed by the same co-planar conductive plate. The oscillator portion 53 includes four oscillator arms 531-534 which are of square shape and distributed in such manner that they have the same horizontal distance and vertical distance from each other. As a result, the four oscillator arms 531-534 define in totality a larger square configuration. Any two arms located along either of the diagonal lines of the square define a half-wave oscillator (for example, the arms 531 and 533 form a half-wave oscillator, while the other two arms 532 and 534 form another half-wave oscillator). Viewed from geometry, each half-wave oscillator (one is formed by the arms 531 and 533, while the other one is formed by the arms 532 and 534) is defined by two small square frames located on the same diagonal line. To supply power to each half-wave oscillator, two feeding terminals (such as terminals 5310 and 5330; or terminals 5320 and 5340) should be provided respectively at two corner portions facing each other, of two arms aligned diagonally (such as pair of arms 531 and 533; or pair of arms 532 and 534). Accordingly, there are four feeding terminals 5310, 5320, 5330 and 5340 for two half-wave oscillators (one is formed by the arms 531 and 533, while the other one is formed by the arms 532 and 534). For easy connection of the connective element 3, a plurality of through holes should be defined in the medium base plate 51 at locations corresponding to respective feeding terminals 5310, 5320, 5330 and 5340 for passage of the connective element 3.

The connection portion 2 in this embodiment is of a square larger than the square defined by the above four oscillator arms 531-534. The square defined by the connection portion 2 surrounds the two half-wave oscillators. In addition, the material 54, of which the connection portion 52 and oscillator portion 53 are made, connects the four arms 531-534 with the connection portion 52 at four corners of a square defined by the four arms 531-534. The material 54 may also be regarded as part of the connection portion 52. As this kind of connection is made only at the above four corners, two cutout portions 61 and 62 of I shape may be visible in the drawing of FIG. 2.

According to ordinary knowledge of antenna, the symmetrical construction as shown in FIG. 2 is also necessary, in addition to integration of the oscillator portion 53 with the connection portion 52.

To form the radiation element 9, the planar oscillator 5 of FIG. 2 may be connected electrically with two kind of balanced feeding connectors 2.

Figure 3A:
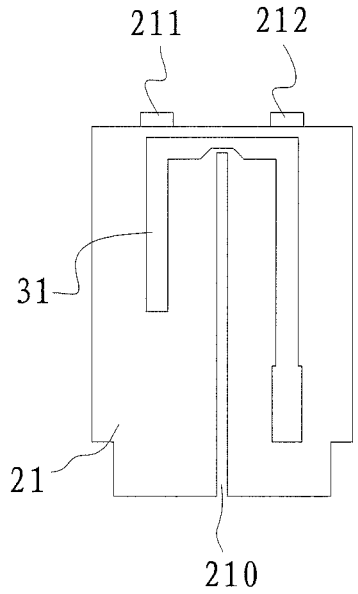
FIG. 3*a* shows a first side view of a first medium plate.
Figure 3B:
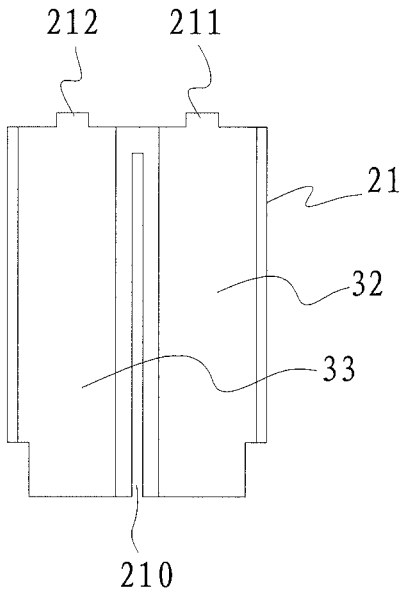
FIG. 3*b* shows a second side view of the first medium plate.
Figure 3C:
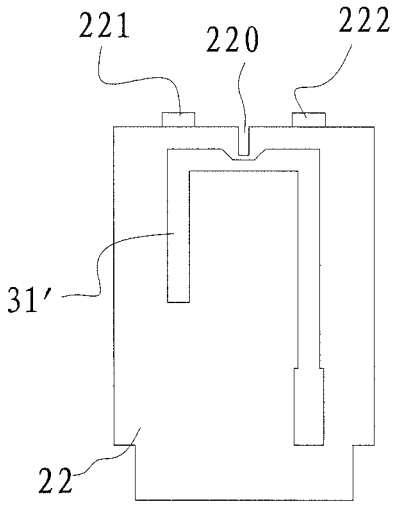
FIG. 3*c* shows a first side view of a second medium plate.
Figure 3D:
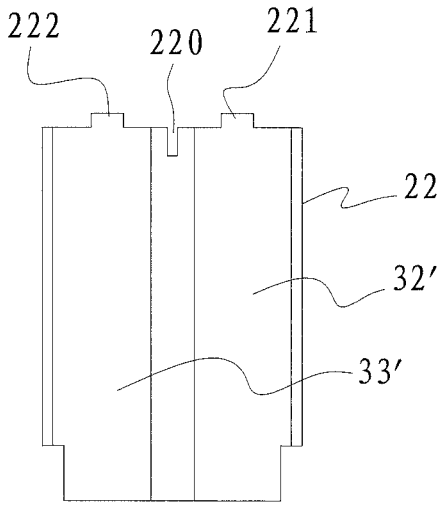
FIG. 3*d* shows a second side view of the second medium plate.

FIG. 3*a*-3*d* show a first kind of balanced feeding connector 2. As shown in this figure, the connector 2 includes two sheet-like medium plates 21 and 22 which have the equal area and thickness. One is a first medium plate 21 shown in FIGS. 3*a*-3*b*, while the other one is a second medium plate 22 as shown in FIGS. 3*c* and 3*d*. A longitudinal notch 210 is defined at the middle portion of the first medium plate 21 and runs from the bottom to top thereof. Similarly, a notch 220 corresponding to the notch 210 is also defined in the second medium plate 22 and runs from the top to bottom thereof. By engagement of the two notches, the first and second medium plates 21 and 22 may be connected with each other in a cross manner. As shown in FIGS. 3*a*-3*d*, two bumps 211 and 212 are formed on the top portion of the first medium plate 21 and similarly, two bumps 221 and 222 are formed on the second medium plate 22. These bumps 211, 212, 221 and 222 are inserted into respective through holes defined in the medium base plate 51 of the planar oscillator 5 to secure the balanced feeding connector 2 with the planar oscillator 5.

FIG. 3*a* shows a first side of the first medium plate 21. A micro-strip line 31 is formed on the first side for feeding signal into a half-wave oscillator (for example one defined by the components with reference numerals 531 and 533) of the oscillator 5. FIG. 3*b* shows a second side of the first medium plate 21 on which two micro-strip lines 32 and 33 are formed and extended from the bumps 211 and 212 to the bottom of the medium plate 21. These micro-strip lines 32 and 33 pass through the respective through holes of the medium base plate 51 and then are connected with the feeding terminals 5310 and 5330 of the half-wave oscillator (defined by the arms 531 and 533) in order to be grounded.

By the same token, a first side of the second medium plate 22 is shown in FIG. 3*c*. A micro-strip line 31' is foamed on the first side of the second medium plate 22 for coupling the signals to the other half-wave oscillator (defined for example by the arms 532 and 534) of the planar oscillator 5. FIG. 3*d* shows a second side of the second medium plate 22 on which two micro-strip lines 32' and 33' are formed and extended from the bumps 221 and 222 to the bottom of the medium plate 22. These micro-strip lines 32' and 33' pass through the respective through holes of the medium base plate 51 and then are connected with the feeding terminals 5320 and 5340 of the half-wave oscillator (defined by the arms 532 and 534) in order to be grounded.

The connective element 3 is constituted by these micro-strip lines 31, 32, 31', 32', and 33' printed on the surface of the balanced feeding connector 2.

Figure 4:
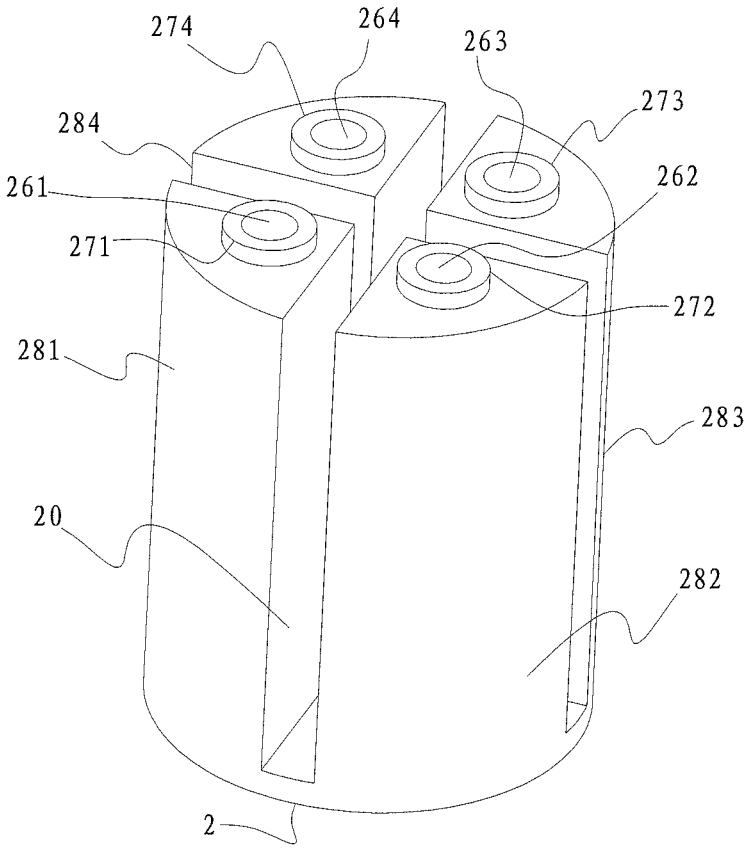
FIG. 4 illustrates a perspective view of another balanced connective feeder according to the invention.

FIG. 4 shows another kind of balanced feeding connector 2 for connection with and supporting the planar oscillator 5 of the invention.

As shown in FIG. 4, the balanced feeding connector 2 is of a cylinder shape and a cross groove 20 is defined at the central portion thereof which divides the entire connector 2 into four sectored posts 281-284. Each sectored post (281-284) has an embossment (271-274) is formed on the top portion thereof for corresponding to respective through holes defined in the medium base plate 51 of the planar oscillator 5. A plurality of receiving holes 291-294 is defined in the plurality of embossments 271-274 respectively for receiving the connective element 3 therein. Each receiving hole is extended downwardly from a respective embossment to the bottom portion of a respective sectored post. In this sort of balanced feeding connector 2, the connective element 3 may be a coaxial cable with an external conductor and an internal conductor formed thereon. The external conductor is connected to the inner wall of respective posts 281-284, while the internal conductor thereof reaches the embossments 271-274, travels across the through holes defined in the medium base plate 51 of the planar oscillator 5, and finally is connected with the feeding terminals 531-534 so as to feed signals to respective half-wave oscillators (one oscillator is formed by the arms 531 and 533, while the other one is formed by the arms 532 and 534).

There exists structure for fixation of the two kind of balanced feeding connectors 2 with the metal reflection plate 1. In addition, the metal reflection plate 1 is provided with certain circuit element for connection with said connective element 3, as known by a person of ordinary skill in the art.

Figure 5:
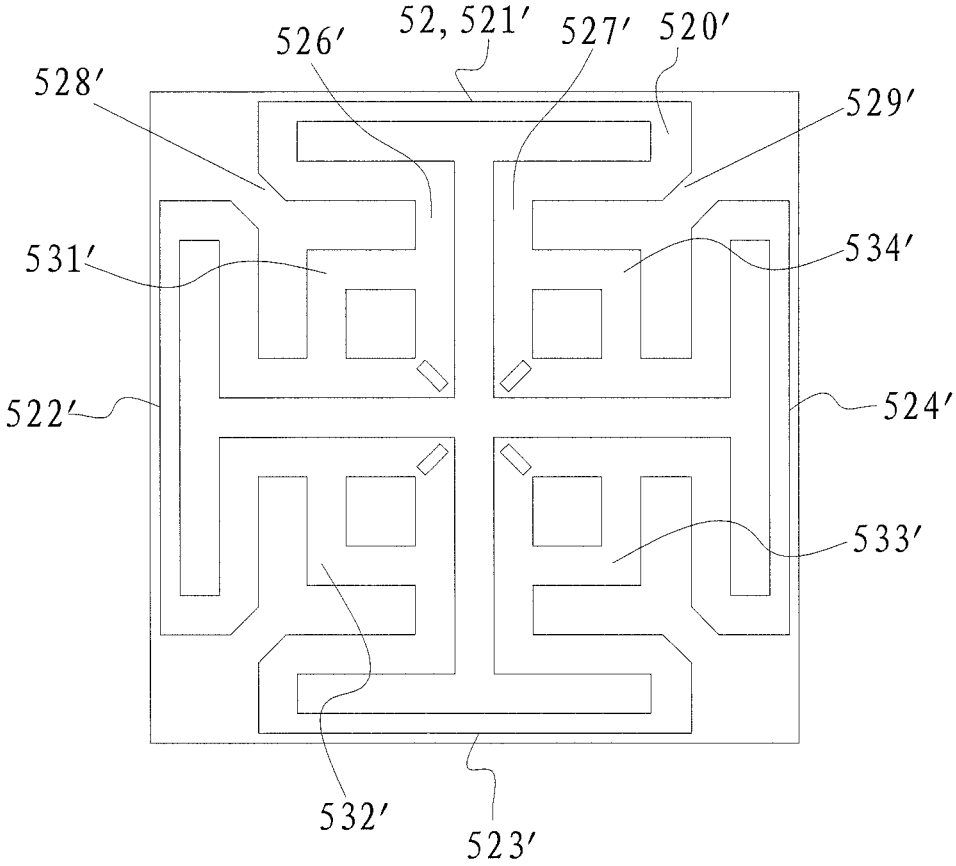
FIG. 5 denotes a top plan view of another planar oscillator of the invention.

Another embodiment of the invention is illustrated in FIG. 5 for further explanation of the principle of the invention. The difference between this embodiment and the previous embodiment lies in the design of the connection portion 52'. Keeping the arrangement of four oscillator arms 531'-534' unchanged, it can be seen that a cross cutout portion (as denoted by numerals 610' and 620') is defined at the center of a square formed by the four arms 531'-534'. The four arms 531'-534' are separated by said cross cutout portion.

The connection portion 52 in this embodiment includes four extension frames 521'-524'. Each of the frames has a T shape. In addition, each frame is cut out in its central portion so as to define a T shape at the center. Specifically, each extension frame 521'-524' includes a longitudinal rectangular frame 520'. A side of the longitudinal frame 520' is broken and two arm portions 526' and 527' are extended from the breaking location. The width between the two extended arm portions 526' and 527' is equal to that between two adjacent oscillator arms 531' and 534' (that is, the width of the cutout portion 610'). As such, four extension frames 521'-524' are capable of being received into upper, lower, left and right locations of the cross cutout portion. The two arm portions (such as portions 526' and 527') of each extension frame 521'-524' are connected with two adjacent sides of two adjacent oscillator arms (such as arms 531' and 533'), thus connecting the oscillator portion 53 to the connective portion 52.

Due to the design of arm portions of each extension frame, each extension frame has two rectangular corners. Therefore, when the four extension frames 521'-524' are connected completely with four oscillator arms 531'-534', two adjacent extension frames (such as frames 521' and 522') and an oscillator arm (such as arm 531') connected thereto form a large rectangular frame. Accordingly, two openings (such as those denoted by 528' and 529') are defined at two lateral ends of a longitudinal side, on which the arm portions 526' and 527' are formed, of the rectangular frame 520'.

Oscillator arm of square shape means wide range of frequency and high gain. Connection of the distal end of the oscillator by the connective portion 52 improves current balance, as well as cross polarization ratio of the antenna.

According to the latter embodiment of the invention, design of the above openings defined at each extension frame also improves impedance performance of the antenna and radiation frequency width of the antenna as well.

Testing shows that the invention may be adapted to various range of frequency, including GSM (806 MHz-960 MHz), DCS/UMTS (1710 MHz-2170 MHz), WIMAX (2300 MHz-2700 MHz, 3300 MHz-3800 MHz) and the like.

Figure 6:
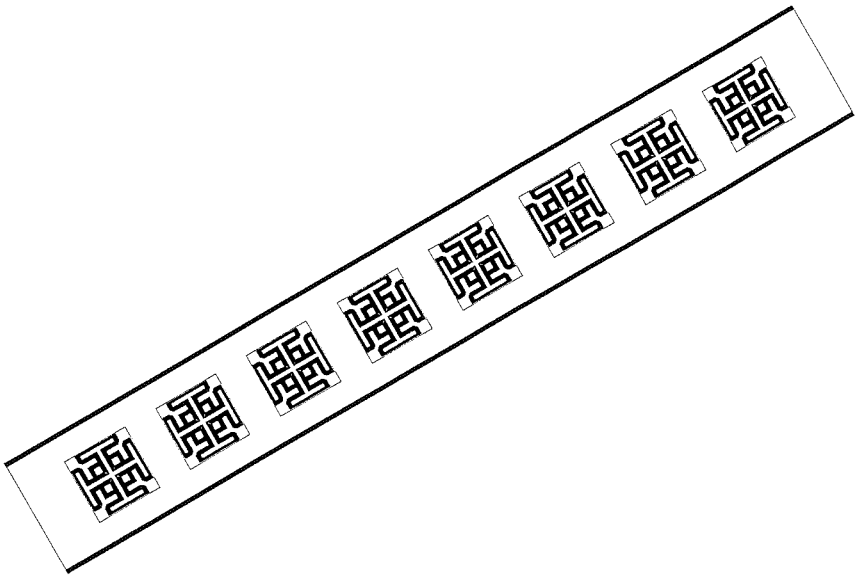
FIG. 6 is a view showing the structure of an antenna array consisted of the planar oscillators shown in FIG. 5.

Antenna array constructed of the plurality of dual polarized radiation elements 9 of the invention is shown in FIG. 6. As shown in this figure, good radiation pattern is demonstrated at all frequency bands under different testing environment such as indoor and outdoor circumferences. Voltage standing wave ratio at frequency of 2300-2700 MHz is less than 1.5, and isolation rate is larger than 30 dB. The gain of an 8-unit antenna array is measured to be within 16 dBi-17 dBi. Beam width of the horizontal plane of the antenna at 3 dB is between 58-62 degree, while the cross polarization ratio of the main axis takes a value larger than 20 dB. In other words, the invention may sufficiently meet the demand of the mobile communication system.

Obviously, the antenna made according to the invention is simple and compact in construction and good in performance. In addition, the antenna is easy to be manufactured and assembled. Moreover, the antenna of the invention benefits from wideband, high gain and cross polarization ratio, and excellent isolation.

What is claimed is:

1. A planar oscillator for a dual polarized radiation element of an array of antenna, comprising:

An oscillator portion formed by four oscillator arms, the four oscillator arms defining two orthogonal half-wave oscillators, each oscillator arm being of a square and these oscillator arms being arranged in a square configuration, each oscillator arm having a feeding terminal defined at a corner thereof facing another oscillator arm;

A connective portion connected among these oscillator arms so that these arms are connected with each other; and A medium base plate on which the oscillator portion and connective portion are printed and a plurality of through holes is defined.

2. The planar oscillator according to claim 1, wherein the connective portion is of a square shape and is disposed at the periphery of the oscillator portion and connected with four corners of the periphery of the oscillator portion.

3. The planar oscillator according to claim 1, wherein the connective portion includes four extension frames each of which has a rectangular frame and two extension arms extended from two ends of a breaking location of a longitudinal side of the rectangular frame; the two extension arms of each extension arm are connected with two adjacent sides of two adjacent oscillator arms respectively.

4. The planar oscillator according to claim 3, wherein an opening is defined between two adjacent corners of two adjacent extension frames.

5. The planar oscillator according to claim 1, wherein the oscillator portion is formed integrally with the connective portion.

6. A dual polarized radiation element for forming an array of antennae, comprising:

A planar oscillator according to claim 1; and

A balanced feeding connector the bottom portion of which is secured onto a metal reflection plate of the array of antennae, while the top portion thereof is fixed to the planar oscillator for supporting a connective element for feeding power to the planar oscillator.

7. The dual polarized radiation element according to claim 6, wherein the balanced feeding connector comprises two identical medium plates; each medium plate has a notch defined at its middle portion longitudinally such that the two medium plates are connected with each other in a crossed manner; two bumps are formed on the top portion of each medium plate; each medium plate has a micro-strip line formed at one side thereof and extended from the bumps to the bottom of the medium plate, said micro-strip line passing through the through holes defined in the medium base plate of the planar oscillator for connecting with the feeding terminal so as to be grounded; each medium plate also has another micro-strip line formed at the other side thereof for coupling the signals to one of the two half-wave oscillator; and these micro-strip lines constitute the connective element.

8. The dual polarized radiation element according to claim 6, wherein the balanced feeding connector is of a cylinder shape; a cross groove is defined at the central portion of the balanced feeding connector for dividing the connector into four sectored posts; an embossment is formed on the top portion of each sectored post; a receiving hole is defined in the post and extended from the embossment downwardly to the bottom portion of the post for receiving the connective element; the connective element is of a coaxial cable and has an external conductor and internal conductor; the external conductor is connected with the inner wall of the sectored post, while the internal conductor thereof reaches the respective embossment and passes through the through hole of the medium plate of the planar oscillator so as to be connected to the feeding terminal provided on the other oscillator arm.

* * * * *